US006740180B1

(12) United States Patent
Cesaroni

(10) Patent No.: US 6,740,180 B1
(45) Date of Patent: May 25, 2004

(54) THERMOPLASTIC POLYMER PROPELLANT COMPOSITIONS

(76) Inventor: Anthony Joseph Cesaroni, 9 Heathmore Court, Unionville, Ontario (CA), L3R 8J1

( * ) Notice: Subject to any disclaimer, the term of this patent is extended or adjusted under 35 U.S.C. 154(b) by 0 days.

(21) Appl. No.: 09/613,090

(22) Filed: Jul. 10, 2000

Related U.S. Application Data

(63) Continuation-in-part of application No. 09/115,441, filed on Jul. 15, 1998, now abandoned

(60) Provisional application No. 60/164,297, filed on Nov. 8, 1999.

(30) Foreign Application Priority Data

Jul. 15, 1997 (CA) ..... 2210438

(51) Int. Cl.[7] ..... C06B 45/10; C06B 31/00; C06B 29/22

(52) U.S. Cl. ..... 149/19.91; 149/45; 149/76

(58) Field of Search ..... 149/19.91, 45, 149/76

(56) References Cited

U.S. PATENT DOCUMENTS

| | | | | | |
|---|---|---|---|---|---|
| 2,541,389 | A | * | 2/1951 | Taylor | 52/5 |
| 2,783,138 | A | * | 2/1957 | Parsons | 52/5 |
| 3,745,927 | A | * | 7/1973 | Tanner et al. | 102/103 |
| 3,793,099 | A | * | 2/1974 | Duerksen et al. | 149/19 |
| 3,830,672 | A | * | 8/1974 | Lista | 149/7 |
| 3,830,673 | A | * | 8/1974 | Fletcher et al. | 149/17 |
| 4,000,024 | A | * | 12/1976 | Roberto et al. | 149/19.9 |
| 4,084,992 | A | * | 4/1978 | Hightower et al. | 149/17 |
| 4,099,376 | A | | 7/1978 | Japs | 60/253 |
| 4,460,411 | A | | 7/1984 | Ohtake et al. | 106/183 |
| H717 | H | * | 12/1989 | Stephens et al. | 149/19.2 |
| 4,985,094 | A | | 1/1991 | Nahlovsky et al. | 149/19.92 |
| 5,009,728 | A | | 4/1991 | Chan et al. | 149/19.1 |
| 5,120,479 | A | | 6/1992 | Chan et al. | 264/3.1 |
| 5,180,452 | A | * | 1/1993 | Lund et al. | 149/19.9 |
| 5,183,520 | A | | 2/1993 | Wanninger et al. | 149/19.91 |
| 5,458,706 | A | | 10/1995 | Finck et al. | 149/19.2 |
| 5,472,529 | A | | 12/1995 | Arita et al. | 149/2 |
| 5,547,526 | A | | 8/1996 | Wanninger et al. | 149/19.92 |
| 5,587,553 | A | * | 12/1996 | Braithwaite et al. | 149/19.6 |
| 5,750,921 | A | * | 5/1998 | Chan et al. | 149/19.92 |
| 5,834,680 | A | | 11/1998 | Nielson et al. | 102/336 |

OTHER PUBLICATIONS

George P. Sutton, "*Rocket Propulsion Elements: An Introduction to the Engineering of Rockets*", Sixth Edition, John Wiley & Sons, Inc.

Alain Davenas, "*Solid Rocket Propulsion Technology*", Pergamon Press.

* cited by examiner

*Primary Examiner*—Michael J. Carone
*Assistant Examiner*—Aileen B. Felton
(74) *Attorney, Agent, or Firm*—Ohlandt, Greeley, Ruggiero & Perle, L.L.P.

(57) ABSTRACT

A propellant is disclosed, comprising, as binder, an ethylene copolymer especially ethylene/vinyl acetate copolymer. The binder may be silane-grafted and moisture curable. A solid propellant composition may contain a plasticizer that is solid or semi-solid at 20° C., and an additive to increase one or more of elongation, adhesion and tack. Examples of the solid or semi-solid plasticizer are selected from microcrystalline wax, macrocrystalline wax, an oxidized hydrocarbon polyolefin and a polyketone wax. Examples of the additive are selected from an aliphatic hydrocarbon, an aromatic, a hydrogenated hydrocarbon resin and a derivative of a rosin. Preferably, the binder composition contains 10–30% by weight of liquid plasticizer, 0–30% by weight of solid or semi-solid plasticizer and 20–40% by weight of at least one said additive. The propellant is particularly useful as a rocket propellant. A method of manufacture is disclosed.

42 Claims, 3 Drawing Sheets

THERMOPLASTIC POLYMER PROPELLANT COMPOSITIONS

This application is a continuation-in-part of U.S. application Ser. No. 09/115,441 now abandoned which claims benefit of Prov. No. 60/164,297 filed Nov. 8, 1999.

FIELD OF THE INVENTION

The present application relates to propellant compositions e.g. rocket propellant or gas generator compositions, that have a binder formed from compositions of thermoplastic ethylene co-polymers, especially ethylene/vinyl acetate polymers (EVA) and other related polyolefins. In embodiments, the binder is a composition of cross-linkable thermoplastic ethylene copolymer, especial cross-linkable ethylene/vinyl acetate copolymer or related cross-linkable polymer. An example of a cross-linkable polymer is silane-grafted EVA.

BACKGROUND TO THE INVENTION

The original black powder rocket propellants were replaced In the early 1900's with propellants based on nitrocellulose and nitroglycerin. Subsequently propellants were developed that were based on a fuel oil, a binder e.g. asphalt, and an oxidizer e.g. potassium perchlorate. Polysulphide fuel binders that could be cast and cured at cool temperatures, mixtures of ammonium perchlorate, polyester and styrene cured by cumene hydroperoxide and compositions based on polyvinyl chloride plastisols were also developed.

A number of polybutadiene materials, including in particular polybutadiene acrylonitrile, carboxy terminated polybutadiene and hydroxy-terminated polybutadiene have also been developed and undergone commercial use. In particular, repellent compositions using polybutadiene acrylonitrile (PBAN) as binder hive been developed and are used in a number rocket systems, including the solid rocket boosters for the Space Shuttle. Propellant compositions using hydroxy-terminated polybutadiene (HTPB) are also known and in use. It is understood that systems utilizing thermoset polymers such as PBAN and HTPB exhibit relatively long curing times (several days) unless promoted through heat and/or catalysis, and that pot-life suffers accordingly, and may be as short as about 20 minutes. In most cases, propellant compositions using the above binder systems and related systems require the use of toxic chemicals such as epoxides, dilsocyanates or aziridines as curing agents. In addition, plasticizers e.g. ethyl hexyl acrylate or di-octyl adipate may be used, which are also known to exhibit toxicological properties. In addition to safety considerations during manufacture of the propellants, the cost of many of these constituents is relatively high.

The shelf life of some of these constituents, such as epoxides and dilsocyanates, tends to be short. Special handling e.g. freezing or refrigeration and/or inert gas blanketing, is required to extend their useful life, which further increases the overall cost of the propellants. Of greater concern is the potential for allergic reactions and the consequent need for special handling in order to protect persons handling the compositions.

Propellant compositions offering greater flexibility, less stringent handling requirements and less lead time in fabrication would be useful.

SUMMARY OF THE INVENTION

Propellants formed from compositions of thermoplastic polymers, and methods for the manufacture thereof, have now been found.

Accordingly, an aspect of the present invention provides a solid propellant composition comprising a binder and at least 65% by weight of a material selected from the group consisting of oxidizer and crystalline high explosive, said binder being selected from the group consisting of a thermoplastic ethylene copolymer and a cross-linkable thermoplastic ethylene copolymer.

In preferred embodiments of the invention, the ethylene copolymer is ethylene/vinyl acetate copolymer or other ethylene/vinyl alkanoate copolymer or the copolymer is selected from an ethylene/ethyl acrylate copolymer, ethylene/methyl acrylate copolymer or ethylene/butyl acrylate copolymer, a copolymer of ethylene with acrylic acid or methacrylic acid, an ionomer thereof and a copolymer of ethylene with an acrylic or methacrylic acid ester.

In other embodiments, the crystalline high explosive is selected from the group consisting of cyclotetramethylenetetranitramine, cyclotrimethylenetrinitramine and hexanitrohexaazaisowurtzitane and the oxidizer is selected from ammonium perchlorate, ammonium nitrate and potassium perchlorate, especially ammonium perchlorate.

In further embodiments, the binder is cross-linkable ethylene/vinyl acetate copolymer, said copolymer having a moisture crosslinkable monomer, especially in which the moisture crosslinkable monomer is selected from vinyl trimethoxysilane and vinyltriethoxysilane. Alternatively, the binder is a silane-grafted ethylene/vinyl acetate copolymer.

In additional embodiments, the material is oxidizer.

In preferred embodiments, the composition contains at least 70% by weight of oxidizer, especially 75–90% by weight of oxidizer.

In other embodiments, there is at least one of an energetic, a ballistic modifier and a modifier, said energetic being selected from the group consisting of aluminum, magnesium and aluminum/magnesium alloys, said ballistic modifier being selected from the group consisting of oxides of iron, copper, chromium and magnesium and calcium carbonate and said modifier being selected from the group consisting of a titanate, a zirconate and an aluminate.

In further embodiments, there is at least one of an additive selected from opacifiers; stabilizers; metal de-activators; anti-oxidants; flame colorants; or an agent that modifies the processing, performance, mechanical properties, storage stability or shelf life of solid propellant systems. Preferably, the stabilizer is selected from zinc oxide, nickel oxide and triacetin, and the flame colorant is selected from salts of strontium, barium, sodium and lithium. In addition, the oxidizer is preferably a mixture of particle sizes selected from coarse, medium, fine and ultra fine particles, said coarse particles being 400–600 micron, said medium particles being 50–200 micron, said fine particles being 5–15 micron and said ultrafine particles being submicron to 5 micron.

In embodiments, the composition is a gas generator propellant or a rocket propellant.

In preferred embodiments, at least 75% by weight of the material is oxidizer.

In further embodiments the propellant composition additionally comprising a plasticizer that is solid or semi-solid at 20° C., and an additive to increase one or more of elongation, adhesion and tack. The solid or semi-solid plasticizer is preferably selected from microcrystalline wax, macrocrystalline wax, an oxidized hydrocarbon polyolefin and a polyketone wax and the additive selected from a hydrogenated hydrocarbon resin and a derivative of a rosin.

In embodiments, the binder composition contains 35–65% by weight of copolymer, 10–30% by weight of solid or semi-solid plasticizer and 20–40% by weight of said additive. The propellant composition may contain 10–20% of binder.

In other embodiments, the propellant composition comprises 50–90% by weight of oxidizer and 5–20% by weight of ethylene/vinyl acetate copolymer, the remainder of such composition comprising at least one of said crystalline high explosive, plasticizer, energetic, ballistic modifier and other propellant components.

Another aspect of the invention provides a method of manufacture of a propellant composition comprising:

(a) preparing a pre-propellant composition of ethylene copolymer; and (b) admixing the pre-propellant composition with a material selected from oxidizer and crystalline high explosive such that the resulting composition has at least 65% by weight of said material.

In preferred embodiments of the method, the propellant composition obtained in (b) it formed into propellant grains by an extrusion process and/or the grain is consolidated into final form under mechanical, pneumatic or hydraulic pressure or centrifugal force.

In embodiments, the extrusion process utilizes a cooling cycle to cool the propellant grain.

In other embodiments, the pre-propellant composition is prepared by melt blending.

In embodiments, the propellant composition obtained in (b) is formed into fuel grains in a ram extruder.

In further embodiments, there is a cold cycle to cool the propellant grain so obtained.

In other embodiments, the pre-propellant contains at least one of an energetic and ballistic modifier said energetic being selected from the group consisting of aluminum, magnesium and aluminum/magnesium alloys, and said ballistic modifier is selected from the group consisting of oxides of iron, copper, chromium and magnesium, and calcium carbonate. The pre-propellant may contain at least one additive selected from opacifiers; stabilizers; metal de-activators; anti-oxidants; flame colorants; or an agent that modifies the processing, performance, mechanical properties, storage stability or shelf life of solid propellant systems.

In preferred embodiments, the oxidizer is a mixture of particle sizes selected from coarse, medium, fine and ultra fine particles, said coarse particles being 400–600 micron, said medium particles being 50–200 micron, said fine particles being 5–15 micron and said ultra fine particles being submicron to 5 micron.

A further aspect of the intention provides a solid propellant composition comprising a binder and at least 50% by weight of an oxidizer, said binder being an ethylene-vinyl alkanoate copolymer, especially ethylene/vinyl acetate copolymer. The copolymer of the binder may have a moisture crosslinkable monomer, especially vinyl trimethoxysilane or vinyltriethoxysilane. The binder may be a silane-grafted ethylene/vinyl acetate copolymer.

BRIEF DESCRIPTION OF THE DRAWINGS

The present invention is illustrated by the embodiments shown in the drawings, in which.

DETAILED DESCRIPTION OF THE INVENTION

Figure 1:
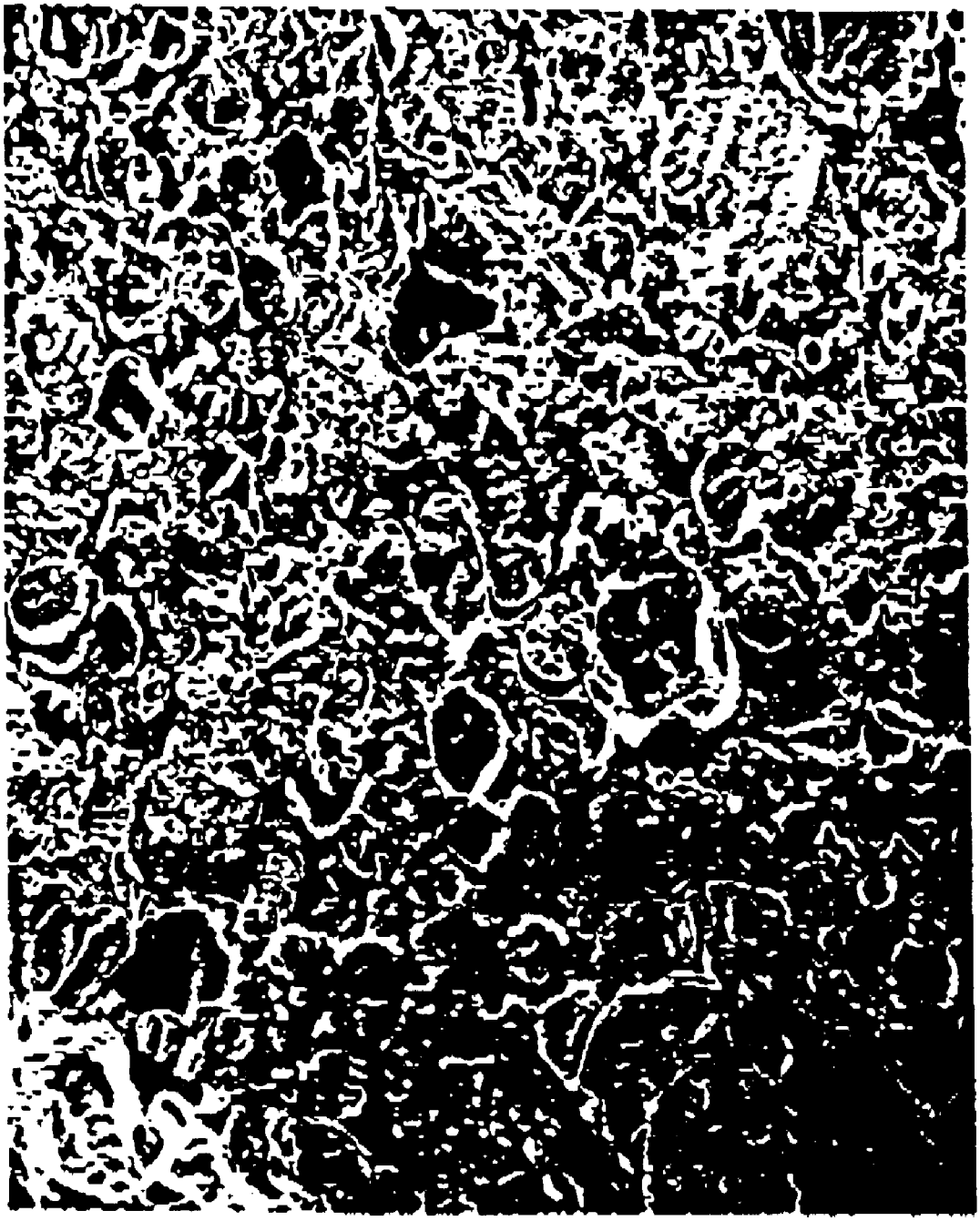
FIG. 1 is a photograph of a control sample of propellant.

The following acronyms are used in this application:

PETN pentaerythritol tetranitrate

TMETN trimethanolethane trinitrate

BTTN butanetriol trinitrate

GAP glycidyl azide polymer

HMX cycloptetramethylenetetranitramine

RDX cyclotrimethylenetrinitramine

PGN propylglycidyl nitrate

BAMO/AMMO bis-azidomethyloxetane/azidomethylmethyloxetane copolymer

BAMO/NMMO bis-azidomethyloxetane/nitramethylmethyloxetane copolymer

PBAN polybutadiene acrylonitrile

HTPB hydroxy-terminated polybutadiene

AP ammonium perchlorate

CL-20 hexanitrohexaazaisowurtzltane

Tho propellants of the present invention are particularly intended for use in rockets, missiles, gas generating devices or similar devices i.e. end-uses requiring propellants. The propellant comprises, as a binder, a composition of an ethylene copolymer, especially an ethylene/vinyl acetate copolymers.

The polymers that are used in the binder compositions of the present invention are ethylene copolymers. Such polymers include copolymers of ethylene and a vinyl alkanoate, especially ethylene/vinyl acetate copolymers (EVA). Alternatively, the polymer may be a copolymer of ethylene and an acrylate ester, examples of which are ethylene/ethyl acrylate copolymers, ethylene/methyl acrylate copolymers and ethylene/butyl acrylate copolymers. The polymer may also be a copolymer of ethylene with acrylic acid or methylacrylic acid or the related ionomers viz. copolymers having the acid groups thereof partially neutralized by metals especially sodium, zinc or aluminum. The polymers may have other copolymerized monomers e.g. carbon monoxide.

Compositions formed from EVA tend to exhibit physical properties equivalent to, or superior to for instance PBAN, and be functional at temperatures of up to about 50° C. Cross-linked compositions may be used at higher temperatures.

The preferred binder is a composition based on ethylene/vinyl acetate copolymer. It has good overall mechanical properties, which may be further improved especially at elevates temperatures, through cross-linking. Propellant compositions may be manufactured for use at temperatures in the range of −65° C. to 130° C. In addition, it has good adhesive properties, which has the potential to eliminate the need for bonding agents as are often required in other systems to improve mechanical adhesion of the binder to the oxidizer particles. These same adhesive properties also potentially eliminate the need for tie-coats or other enhancements of the propellant. These adhesive properties may be enhanced through cross-linking.

The ethylene/vinyl acetate copolymer may have a wide range of melt index (MI). Melt index is measured by the procedures of ASTM D1238. For example, melt indices of from about 0.4 dg/min which is a high viscosity ethylene/vinyl acetate copolymer, up to at least 2500 dg/min are known, and may be selected according to the use. In embodiments, the melt index is in the range of 400–2500 dg/min. Small amounts of plasticizers e.g. polybutene, may be added to either the binder or formulated propellant system to enhance processabillty and/or mechanical properties. Examples of ethylene/vinyl acetate copolymers include Elvax™ 210, Elvax 220 and Elvax 240 ethylene/vinyl acetate copolymers.

The binder is in the form of a composition of the thermoplastic ethylene copolymer with a plasticizer that is solid or semi-solid at 20° C. and an additive to increase one or more of elongation, adhesion and tack.

Examples of plasticizers that are solid or semi-solid at 20° C. include polyhydrocarbons e.g. polybutene, micro crystalline waxes, macro crystalline waxes, oxidized hydrocarbon polyolefins, which are also known as maleated polyolefins, and polyketone waves. The amount of solid or semi-solid plasticizer may be 10–30% by weight, especially 10–25% by weight.

The binder composition preferably has an additive that increases the elongation, adhesion and/or the tack of the binder composition. Examples of such additives include aliphatic hydrocarbon resins, aromatic hydrocarbon resins, and such resins that have been hydrogenated, and rosin derivatives. Example of rosin derivatives include hydrogenated rosin esters. Such additives may be used in amounts of 20–40% by weight, especially 10–35% by weight.

In preferred embodiments of the invention, the binder composition contains 35–65% by weight of copolymer, 10–30% by weight of solid or semi-solid plasticizer and 20–40% by weight of said additive and especially 45–55% by weight of copolymer, 15–25% by weight of the plasticizer and 25–35% by weight of the additive. The propellant composition preferably contains 10–20% of the binder, and especially 14–18% of binder.

The propellant is comprised of the binder composition i.e. compositions of ethylene copolymer, and at least 65% by weight of an oxidizer and/or crystalline high explosive. In emliodiments in which the binder is a cross-linked ethylene copolymer, the propellant may contain at least 50% by weight of oxidizer, preferably at least 60% by weight and especially at least 70% by weight of oxidizer. The propellant may also contain an energetic, a ballistic modifier and other compounds.

A variety of oxidizers known to the trade may be used, including but not limited to ammonium perchlorate, potassium perchlorate, lithium perchlorate, sodium perchlorate, ammonium nitrate, potassium nitrate, sodium nitrate, strontium nitrate, guanidine nitrate, ammonium dinitramide. Nonetheless, it is understood that other oxidizers could be used.

In preferred embodiments, the propellant contains 75–90% by weight of oxidizer. Ammonium perchlorate (AP) is the preferred oxidizer for many applications because it is relatively non-hygroscopic, stable during normal storage and fabrication procedures and relatively low in cost, in addition to providing good performance.

A variety of crystalline high explosives may be used. Examples of the crystalline high explosives include HMX, RDX and CL-20.

As in other solid propellant systems, oxidizers may be incorporated in various particle sizes as necessitated by bum rate requirements, process rheology, solids loading, and commercial availability. Typically, propellant system utilize blends of particle sizes to improve packing density and thus achieve a high solids loading as is necessary for high performance. Typical coarse sizes of ammonium perchlorate, for example, would be 400–600 microns, medium sizes would be 50–200 microns, and fine AP e.g. ground onsite, commonly would be have a mean particle size of 5–15 microns. Ultrafine and other particle sizes may also be present e.g. particle sizes from submicron to 5 microns. A mixture of more than one particle size would normally by used.

In addition to the above, the propellant may contain one or more of the following: fuel additives, e.g. metal or non-metal powders or metal hydrides; energetic materials, liquid high explosives such as TMETN or BTTN; ballistic modifiers e.g. ferrocene or ferrocene derivatives, borohydrides, copper chromite, oxamide, oxides of iron, lead, chromium, copper, magnesium, and others; thermally-conductive burn rate modifiers such as silver wire staples or graphite whisker, coupling agents/rheology modifiers such as titanates, zirconates, aluminates; bonding agents; opacifiers, stabilizers, metal de-activators, anti-oxidants, or other agents known to the trade to modify processing, performance, mechanical properties, storage stability or shelf life. Examples of stabilizers include zinc oxide, nickel oxide and triacetin. Examples of flame colorants include salts of strontium, barium sodium and lithium.

Examples of energetic materials are solid high explosives such as nitroguanidine, nitrocellulose, PETN, lead azide, sodium azide; liquid high explosives such as nitroglycerin, diethylene glycol dintrate, triethylene glycol dinitrate, TMETN, BTTN, energetic polymeric binders such as glycidyl azide polymer BGN, BAMO/AMMO and BAMO/NMMO.

In order to obtain the propellant, according to one embodiment of the invention, the co-polymer in the form of pellets or powder may be mixed in a dry state with an oxidizer e.g. amnmonium perchlorate.

Fuel additives, energetic materials and other modifiers may be added at this stage, or in many cases hay be pro-blended into the polymer. As noted herein, a pre-propellant is an important feature of an aspect of the invention. The dry mixture is they heated e.g. to about 85–130° C., to form a mixture that is flowable. The resultant mixture may then be transferred to a mould and subjected to moderate pressure in order to form a fuel grain. In preferred embodiments of the method of manufacture of propellant compositions, a pre-propellant composition is formed. In this method, the polymer is mixed with some or all of the additives and modifiers required in the final formulation, excluding oxidizer and energetic materials and any catalysts. The resultant composition is then pelletized or powdered in an extruder. To manufacture a propellant composition from this material, it may be pre-coated with a plasticizer, e.g. polybutene, to assist in heat transfer, this step may be eliminated in many instances. The oxidizing and energetic materials and any other additives are then added, and the subsequent mixture is mixed at a typical temperature of about 85–130° C., to form a flowable, heterogeneopus propellant composition.

The composition is then formed into propellant grains. In a typical process, the propellant is pre-loaded into the case liner using a ram extruder. The pre-loaded composition is then transferred to a press, in which the grain is formed under moderate pressure, conforming to the inner surface of the liner, and to the core mandrel which defines the profile of the inner core of the propellant grain (if required). The mandrel and/or clamping blocks which retain the grains may be pre-heated to minimize surface freezing, then switched to a cold cycle during a pressing operation to speed the overall cure cycle. Small propellant grains have been formed by this method with a cycle time of 30–120 seconds, but it is anticipated that shorter cycle times may be achieved.

The resultant propellant grains have a uniform consistency, showing excellent distribution of the constituents, especially when compared to non de-gassed pour-cast propellant compositions, with an absence of significant bubbles. The propellant shows a high tensile strength and elongation at break. Such properties, in addition to good adhesive properties, are important for the finished propellant grain in order to minimize mechanical problems during storage and handling.

As noted herein, in more preferred embodiments of the method of manufacture of the propellant compositions, a pre-propellant composition is formed using EVA. The EVA is mixed with modifiers e.g. zirconates, aluminates or titanates, with energetic e.g. aluminum, magnesium, aluminum/magnesium powders, optionally with zinc powder or chlorinated hydrocarbons if tracing is requires, and any ballistic modifiers to modify the burn rate e.g. iron oxide, copper oxide, chromium oxide or magnesium oxide, or calcium carbonate. The resultant composition is pelletized in an extruder. To add oxidizer to the pellets, the pellets may be coated with polybutene and then oxidizer e.g. ammonium perchlorate added. The ammonium perchlorate is typically a mixture of particle sizes which aide in formation of a uniform composition with high volumetric solids loading. The resultant mixture of oxidizer and pallets is mixed to a dough-like consistency, which may be formed into a cylindrical preform for the forming of propellant grains.

Propellant grains are then formed in a ram extruder, under pressure, using a rapid hot/cold cycle. The use of a ram extruder permits the fabrication of propellant grains of complicated or sophisticated shapes without the need for post-forming operations. The requirment for vacuum de-gassing is believed to be reduced or eliminated. However, the process may easily be run under vacuum to effect removal of trapped and dissolved gases, traces of volatiles, etc. It is understood that other fabrication techniques may be used.

Propellant grains formed in the ram extruder have a uniform consistency, even when viewed under a microscope as shown in the Figures herein, especially compared to PBAN, with an excellent distribution of constituents and an absence of significant bubbles. The propellant grains have high tensile strength and elongation. Such properties are important for the propellant grain in order to withstand mechanical and thermal stresses during firing in a rocket without cracking. Cracking could have major adverse effects on the rocket, including destruction.

Advantages of ethylene/vinyl acetate thermoplastic copolymer-based solid propellant binders over existing technologies include less critical limits on mix ratios of the component, easy processing of the pre-propellant, low to non-toxic properties of the binder constituents, the absence of shelf or pot-life problems, the potential absence of vacuum degassing requirements, the ability to recycle components and rapid cure times if required. However, the most significant advantage is likely the lead time required for the production of propellants for rocket motors, because either the pre-mixed propellant or the individual ingredients can be stored indefinitely. Thus rocket motors, or other propellant-using systems, could be produced on a just-in-time basis for rapid deployment in the field of use. In addition, components may be safely stored near a location where the propellant is to be used, and manufactured as needed in apparatus that is easy to operate.

The manufacture of the pre-propellant i.e. propellant without oxidizer, is a rapid continuous process utilizing apparatus known in the plastics industry. Similarly, the mixing of pre-propellant and oxidizer, end the forming of fuel grains may also be operated on a continuous basis. In both instances, recycle of materials may be used, but the amount of recycle material should be minimal. Nonetheless, the ability to recycle components is an important characteristic of the present invention as it improves economics of the process and reduces or eliminates the need to dispose of components of the propellant by for example, burning. This is environmentally advantageous.

It is understood that recycling would normally not be carried out with cross-linked compositions. However, cross-linkable compositions may be recycled. For instance, the pre-propellant would normally be prepared without the cross-llnking catalyst, which-would permit recycling for a period of time.

In embodiments of the invention, especially where higher temperatures are involved in deployment and service, especially ambient or storage temperatures that might exceed about 40° C., the propellant compositions may be formed with a crosslinked copolymer. Cross-linked polymer may also be used at other temperatures including low ambient temperatures, but generally is not necessary. Cross-linking vtill improve physical properties, especially at elevated temperatures. It will further reduce the likelihood of cracking, slumping, de-bonding or other mechanical problems of the propellant compositions. In these embodirrents, the propellant compositions is formed using a polymer that has a moisture-crosslinkable monomer copolymerized into the polymer or grafted onto the polymer. Examples of moisture-crosslinkable monomers are vinyl silanes, particularly vinyl trialkoxysilanes, examples of which are vinyl trimethoxysilane and vinyl triethoxysilane. Such silanes are available commercially. In addition, compositions containing vinyl silane, grating catalyst and crosslinking catalyst are also available commercially.

Polymers containing vinyl silanes must be maintained in a moisture-free environment at all times prior to the desired time of crosslinking. Crosslinking may be effecting by exposure to moisture, especially by merely exposing the article to atmospheric conditions. Curing by contacting with water, especially steam, is not preferred in view of effects of water on the propeliants. Crosslinking may take place over a pediod of a few days in the presence of atmospheric moisture, it being understood that the shape and thickness of the fuel grain is a factqr in the cross-linking rate, as the crosslinking ieactlon is believed to be controlled by the rate of diffusion of water into the fuel grain. Crosslinking catalysts are normally incorporated into the composition. Techniques for the manufacture of moisture-crosslinkable polymers, and for the curing of such polymers are known.

An advantage of the use of ethylene/vinyl acetate copolymers as the binder in propellants is the increased safety that may be achieved during the manufacturing process. Energetic materials such as aluminium powder must be handled carefully during traditional fuel-grain manufacturing processes, as air-borne metallic powders can be extremely volatile under certain conditions. According to the present invention, the energetic materials may be compounded with the thermoplastic polymer in compounding extruders. In such a method, the energetic materials would be inhibited and would no longer pose a hazard during shipping or the manufacture of fuel-grains. It is understod that such powders are frequenty compounded with thermoplastic polymers as colorants or dyes for such polymers.

Shelf life of the components, including in particular the compounds of the pre-propellant that is formed, is generally indefinite. Thus, pot-life is not a consideration. However, if crosslinked compositions are prepared, steps must be taken to protect the vinyl compounds from moisture, as discussed above.

The present invention provides a fuel grain with uniform properties, and a method of manufacture that is versatile and easy to operate. Components may be reycled.

The propellant compositions may be used in a variety of end uses, including at rocket propellants or in gas generators. The latter use a propellant composition to produce gas for mechanical work such as start a turbine engine, drive a piston, or inflate an airbag, in contrast to a rocket motor which exhausts the gas through a nozzle to generate a reaction force.

One of the most desirable features of the present invention is that unlike most conventonal propellarr systems and processes this invention provides a propeliant system and process which exhibts the combination of a very long or nearly indefinite pot-life, with a very short casting and curing time. The present invention is illustrated by the following examples.

Example I

A control sample (Sample #1) of a first typical AP/AI/HTPB propellant composition was prepared. This composition employed a tri-modal blend of 400, 200 and 90 micron AP, 3 micron spherical aluminum, and HTPB binder, in addition to HX-878 bonding agent and carbon black opacifier in minor percentages. This sample was processed under atmospheric pressure, to show the severe porosity of propellants processed in this manner.

The total time required for preparation, including weighing, mixing and cast cycle time was 6 hours. The cure time was 2 days.

FIG. 1 shows a photograph of a cross-section of the propellant. The dark pockets are voids of approximately 250–340 micron in diameter. Porosity of this magnitude would at least result in erratic performance and low density of the propellant, and likely result in catastrophic motor failure from pressure fluctuations or adiabatic compression. In addition, the AP particles show weak bonding in the binder matrix as evidenced by the crescent shaped air pockets created during sample preparation.

A socond propellant compiosition (Sample #2) nearly identical to the first sample was prepared, with the major exception that the process was run under high vacuum for 1.5 hour mix cycle. In addition, this composition employed sate of the art bonding agents to enhance adhesion of the binder to the AP particles.

The total time required for preparation, including weighing, mixing and cast cycle time was 6 hours. The cure time was 6 days.

Figure 2:
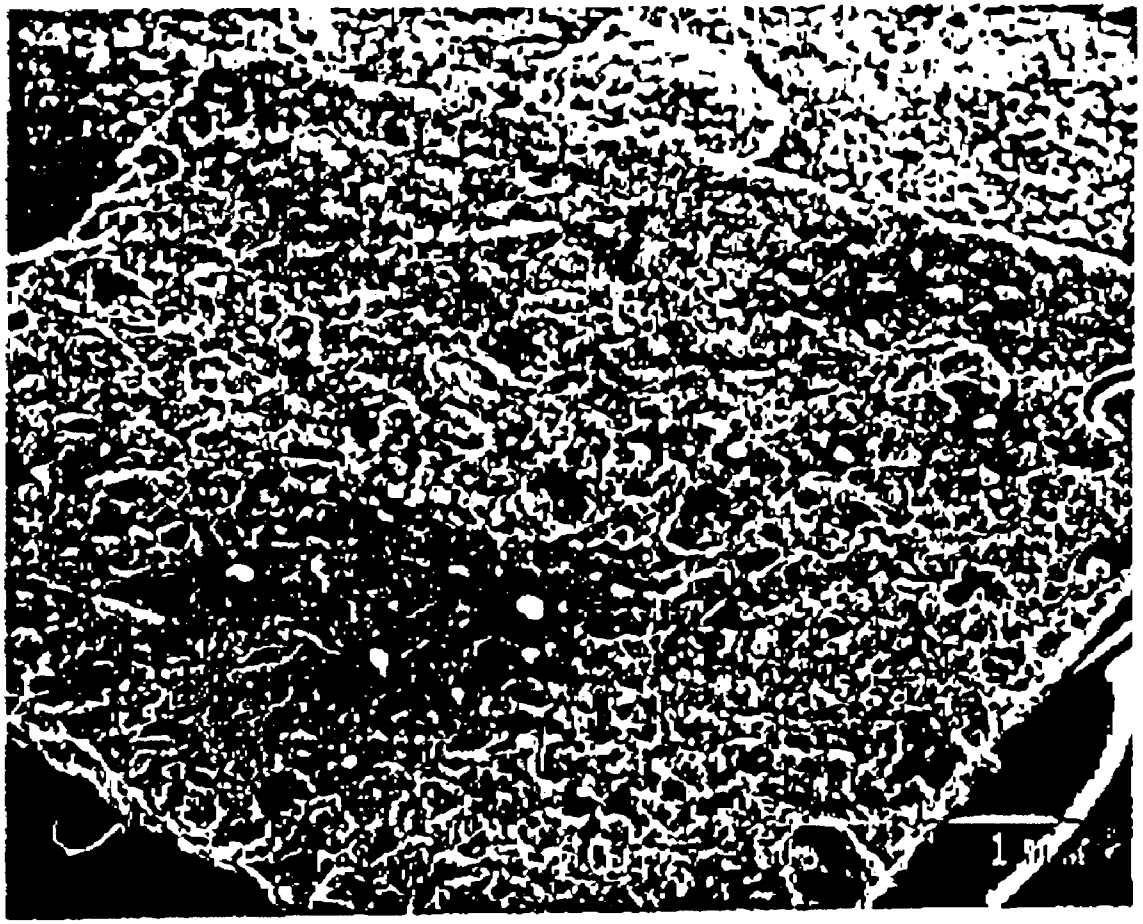
FIG. 2 is a photograph of a second control sample of propellant.

FIG. 2 shows a photograph of a cross-section of the propellant. The surface shows clean cleavage of the AP particles and lack of de-bonding under the shear force of cutting, in addition to an excellent surface distribution profile. Some tearing and pocketing is evident at the perimeter of the sample, as expected during sample preparation. The measured density of this sample is 0.0589 pounds per cubic inch (1630 g/cc).

A sample (Sample #3) of propellant of the invention was prepared, with identical solids composition to the second sample except that ethylene/vinyl acetate co-polymer was used as bihder. The propellant was formed from pre-propellant, using the ram extruder, as described. The total mix cycle for this batch was 20 minutes, under atmospheric pressure (no vacuum).

The total time required for preparation, including weighing, mixing and mix cycle time was 1.5 hours. The time for extrusion, pressing, cooling and curing in non-continuous prototype equipment was 4 minutes/grain.

Figure 3:
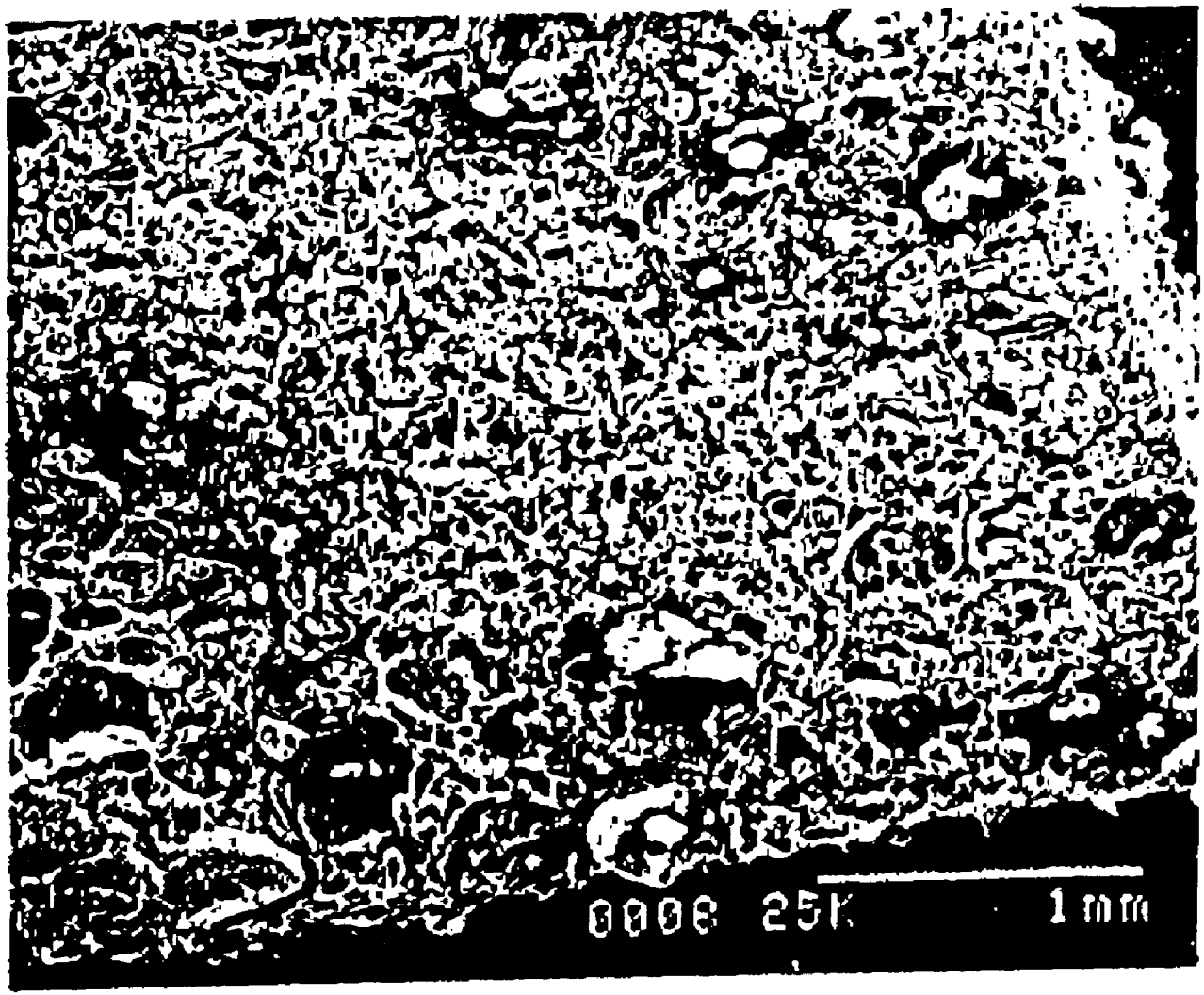
FIG. 3 is a photograph of a propellant of the invention.

FIG. 3 showsa photogaph of a cross-section of the propellant. This sample exhibits the same excellent surface distribution as the second sample above, at well as aggressive bonding of the AP particles to the binder matrix. No voids are visible other than at the periphery of the sample. The measured density of this sample is 0.05961 pounds per cubic inch (1.650 g/cc), an increase of 1.2% over the second sample.

Example II

Propellant compositions were prepared by the following procedure. A mixing bowl was heated to 210–215° F. (99–102° C.). Fine to medium particulate ammonium perchlorate (AP) was fed to the bowl, together with any burn rate catalysts, and mixed for two minutes. All remaining AP was added, and dry mixed for 3–5 minutes at high speed.

A miture of ethylene/vinyl acetate copolymer, polybutene or other plasticizer, rheology modifiers (if present) was prepared. This mixture was added to the mixer. Mixing was continued until the polymer had melted, and then for a further 10 minutes. The resultant mixture was then extruded into propellant grains in the ram extruder.

Example III

The procedure used for preparing pro-propellant blends was as follows. Using a Ross LDM-4 double planetary mixture, the temperature was set at 265° F. (129° C.), when the ethylene-vinyl acetate copolymer was Elvax™ 205 or 210 polymer. All fine dry materials of the composition were added to the mixing bowl, with any dust being allowed to settle. The mixing head was then wiped to remove settled material. The Elvax ethylene-vinyl acetate copolymer and all other medium to coarse materials were added, including fluid ingredients if any. A vacuum was thien applied to the mixture.

The dry mixing cycle was commenced, at low speed mixing. The mixing speed was increased when the temperature passed the melting point of the composition, typically about 100° C., and mixing was continued for 20 minutes. The mixing bowl was scraped down once after about 10 minutes.

The mixing head was then lifted, leaving the blades at the surface of the composition for 1–2 minute to allow adhered material to flow into the bowl with minimal trapped air. The contents of the bowl were then discharged. A similar procedure may be used with different types of mixer, including mixes that do not operate under vacuum.

Example IV

A composition was prepared in a K-5 air mixer. The mixing bowl temperature was set at 99–102° C., and all fine to medium sized particulate ammonium perchlorate and any burn rate catalyst was added to the mix bowl. The mixtule was then mixed at high speed for 2 minutes. Any remaining ammonium perchlorate was addsd and the resultant mixture was preheated for 3–5 minutes under high speed mixing. A mixture of Elvax ethylene/vinyl acetate copolymer with any polybutene or other plasticizer, rheology modifiers or other ingredients was then added, and mixed at a moderate mixing speed. After the mixture had reached the melting point, the mixture was mixed for a further 10 minutes. The mixture was subsequenty extruded into grains.

Using this procedure a composition was prepared as follows:

| Material: | Weight Charged (g) |
|---|---|
| AP-400* | 500.5 |
| AP-200* | 115.5 |
| AP-90* | 153.5 |
| Pre-blend** | 215.5 |
| Polybutene 6 (Soltex) | 10 |
| NZ-33 neo-alkoxy zirconate*** | 5 |
| Batch total | 1000 grams |

*Ammonium perchlorate, with 400, 200 or 90 micron particulate size.
**Pre-blend of Example VII, below.
***Kenrich Petrochemicals, Inc.

Processing was difficult in that the composition exhibited high initial tack, requiring more frequent scraping.

The procedure was repeated, using a pre-blend of binder PB-6 and NZ-33. All ammonium perchlorate was added at the same time. The mixture dispersed easily as it heated, and suddenly transitioned into a crumbly, mobile blend. Extrusion in the ram extruder was good.

Examiple V

The procedure of Example IV was repeated, using the following composition:

| Material: | Weight Charged (g) |
|---|---|
| AP-400 | 479.45 |
| AP-200 | 122.1 |
| AP-90 | 212.3 |
| Pre-blend* | 66.3 |
| Elvax ™ 210 EVA | 103.85 |
| Polybutene-6 | 10 |
| NZ-33 neo-alkoxy zirconate | 5 |
| Iron oxide | 1 |
| Batch Total | 1000 grams |

*Pre-blend of Example VII, below.

This fornulation has reduced aluminum content (2%), an increased amount of 90 micron AP (from 25 to 30% by weight), and iron oxide, with a proportional reduction in ammonium perchlorate of 400 micron size. These changes were intended to reduce nozzle erosion and increase ignition response.

Example VI

A pre-blend batch was prepared with the following composition:

| Material: | Weight Charged (g) |
|---|---|
| Elvax 210 EVA | 719.28 |
| Carbon Black | 2.40 |
| Zinc, 6$\mu$ powder | 1678.32 |
| Batch Total | 2400 grams |

No problems wore experienced in the mixing cycle, the extrusion cycle or pelletising of the pre-blend.

The pre-blend was then formulated into a propellant grain using 50.05% by weight of the pre-blend and 49.95% by weight of 200 micron particulate ammonium perchlorate.

Example VII

A pre-blend was formed of the following composition:

| Material: | Weight Charged (g) |
|---|---|
| Elvax 210 EVA | 2088.17 |
| Carbon Black | 6.96 |
| Aluminum, spherical | 904.87 |
| Batch Total | 3000 grams |

The pre-blend was blended with ammonium perchlorate, to form propellant grain, with the resultant composition containing 21.55% by.weight of the pre-blend.

No problems were encountered in the processing of the composition.

Example VIII

Samples similar to Sample #2 and #3 of Example I were subjected to Martin-Marietta PEPcode analysis to determine characteristics of the compositions as propellants. Sample #2 is a HTPB control sample and Sample #3 is an EVA composition of the invention.

The results obtained were as follows:

| | Sample #2 | Sample #3 |
|---|---|---|
| Density | | |
| lb/in$^3$ | 0.05946 | 0.06017 |
| g/cm$^3$ | 1.6457 | 1.6654 |
| Specific Impulse | | |
| Frozen Flow | 233.9 | 233.3 |
| Shifting Flow | 236.3 | 236.6 |
| Density Impulse | | |
| Frozen Flow | 384.9 | 388.5 |
| Shifting Flow | 388.8 | 394.0 |

The composition of the invention showed a small increase in density and density impulse indicating that the composition is at least equivalent to a HTPB composition, and possibly superior for some uses.

Example VIIII

A series of Elvax® ethylene/vinyl acetate resins having a melt index of at least 150 dg/min were selected, and characterized by physical properties, as follows:

TABLE I

| Type | Melt Index (dg/min) | VA* Content (%) | Tensile Strength (psi) | Tensile Modulus (psi) | Softening Point (° C.) | Elongation At Break (%) | Adhesion |
|---|---|---|---|---|---|---|---|
| 500W | 2500 | 14 | 725 | 5200 | 98 | 90 | Poor |
| 200W | 2500 | 28 | 230 | 1000 | 81 | 90 | Poor |
| 205W | 800 | 28 | 375 | 1700 | 80 | 500 | Fair |
| 410 | 500 | 8 | 675 | 4800 | 88 | 750 | Fair |
| 210W | 400 | 28 | 400 | 1700 | 82 | 900 | Good |
| 310 | 400 | 25 | 475 | 2300 | 88 | 900 | Fair |
| 220W | 150 | 28 | 800 | 2300 | 88 | 900 | Excellent |

VA = vinyl acetate

Three resins were selected for further testing viz. Elvax 500W, Elvax 210W and Elvax 220W. These resins were blended with either Foral 105 rosin ester from Hercules, or Regairez 1094 hydrogenated hydrocarbon resin, also from Hercules. The ethylene/vinyl acetate resins were blended with each of the rosin ester or hydrogenated hydrocarbon resin in ratios of 70:30, which preliminary tests had indicated was a preferred ratio.

A series of tests were conducted, and the results were rated on a scale of from 1–5, with 5 being excellent.

The results obtained are summarized in Table II.

TABLE II

| | Melt Viscosity | Adhesion | Elongation | Tensile Strength | Tensile Modulus | Overall |
|---|---|---|---|---|---|---|
| A. Rosin Ester | | | | | | |
| Elvax 500W/ Foral 105 | 5 | 1 | 1 | 2 | 2 | 4.2 |
| Elvax 210W/ Foral 105 | 4 | 4 | 4 | 4 | 4 | 4 |
| Elvax 220W/ Foral 105 | 2 | 4 | 4 | 5 | 3 | 3.6 |
| B. Hydrogenated Hydrocarbon Resin | | | | | | |
| Elvax 500W/ Regalrez 1094 | 5 | 1 | 1 | 2 | 2 | 4.2 |
| Elvax 210W/ Regalrez 1094 | 4 | 4 | 4 | 4 | 4 | 4 |
| Elvax 220W/ Regalrez 1094 | 2 | 4 | 4 | 5 | 3 | 3.6 |

Elvax 210W ethylene/vinyl acetate resin was selected for further testing. This resin was blended with microcrystalline wax and with polyethylene oxide wax. A series of blends were prepared and evaluated.

The results from evaluation of blends of ethylene/vinyl acetate and polyethylene oxide wax, shown as general trends, were as follows:

TABLE III

| Ratio | Melt Index | Tensile Strength | Adhesion | Overall |
|---|---|---|---|---|
| 80/20 | 2 | 4 | 4 | 3.3 |
| 70/30 | 3 | 3 | 3 | 3.0 |
| 60/40 | 3 | 3 | 3 | 3.0 |
| 50/50 | 4 | 2 | 2 | 2.7 |
| 40/60 | 4 | 2 | 1 | 2.3 |

Similar results were obtained using the ethylene/vinyl acetate resin and microcrystalline wax.

Example X

A variety of propellant formulations were prepared using 14–18% by weight of a binder of 45–55% by weight of Elvax 210W ethylene/vinyl acetate resin, 30% of either Regalrez 1094 hydrogenated hydrocarbon resin or Foral 105 rosin ester and 15–25% by weight of polyethylene oxide wax. The propellant formulations were fourd to have acceptable processability, good mechanical properties and the expected ballistic performance for the formulation.

Example XI

The formulation of Example II was modified by addition of a silane grafting/moisture curing composition. It was found that addition of 1–5 phr, based on the ethylene/vinyl acetates resin, of vinyl trimethoxy silane/dialkyl peroxide/dibutyl tin dilaurate e.g. SilcatR™ gave grafting and subsequent cross-linkings. The melt index was significantly reduced and thermal stability was improved, both of which improved properties of the propellant formulations.

In one example, the formulation was as follows:

| | wt. % |
|---|---|
| Ammonium perchlorate AP-400 | 48.32 |
| Ammonium perchlorate AP-200 | 12.27 |
| Ammonium perchlorate AP-90 | 16.11 |
| Elvax 210/3% SilcatR | 8.90 |
| Regalrez 1094 hydrogenated hydrocarbon resin | 5.34 |
| Polyethylene oxide wax | 3.56 |
| Iron oxide | 0.25 |
| NZ-33 neo-alkoxy zirconate | 0.20 |
| Carbon black, Monarch 8 | 0.05 |
| Magnalium (Mg/Al), fine | 5.00 |

The composition had a burn rate pressure exponent of 0.47, and burn rate at 1000 psi of 0.28 inches/secopnd and a delivered specific impulse at 1000 psi of 224 seconds.

What is claimed is:

1. A solid propellant composition comprising a binder and at least 65% by weight of a material selected from the group consisting of oxidizer and a mixture of oxidizer and at most 50% by weight crystalline high explosive, said binder being selected from the group consisting of a thermoplastic ethylene copolymer and a cross-linkable thermoplastic ethylene copolymer.

2. The propellant composition of claim 1 in which the ethylene copolymer is ethylene/vinyl acetate copolymer.

3. The propellant composition of claim 1 in which the copolymer is selected from an ethylene/ethyl acrylate copolymer, ethylene/methyl acrylate copolymer or ethylene/butyl acrylate copolymer, a copolymer of ethylene with acrylic acid or methacrylic acid, an ionomer thereof and a copolymer of ethylene with an acrylic or methacrylic acid ester.

4. The propellant compositlor of claim 1 in which the copolymer has carbon moboxide as a copolymerized monomer.

5. The propellant composition of claim 2 in which the crystalline high explosive is selected from the group consisting of cyclotetramethylenetetranitramine, cyclotrimethylenetrinitramine and hexanitrohexaazaisowurtzitane.

6. The propellant composition oi claim 2 in which the binder is cross-linkable ethylene/vinyl acetate copolymer, said copolymer having a moisture crosslinkable monomer.

7. The propellant composition of claim 6 in which the moisture crosslinkable monomer is selected from vinyl trimethoxysilane and vinyltriethoxysilane.

8. The propellant composition of claim 1 in which the binder is a silane-grafted ethylene/vinyl acetate copolymer.

9. The propellant composion of claim 1 in which the material is oxidizer.

10. The propellant composition of claim 9 in which the composition contains at least 70% by weight of oxidizer.

11. The propellant composition of claim 9 in which the composition contains 75–90% by weight of oxidizer.

12. The propellant composition of claim 9 in which the oxidizer is selected from ammonium perchlorate, ammonium nitrate and potassium perchlorate.

13. The propellant composition of claim 9 in which the oxidizer is ammonium perchlorate.

14. The propellant composition of claim 2 in which there is at least one of an energetic, a ballistic modifier and a modifier, said energetic being selected from the group consisting of aluminum, magnesium and aluminum/magnesium alloys, said ballistic modifier being selected from the group consisting of iron oxides, copper oxides, chromium oxides, magnesium oxides, and calcium carbonate, and said modifier being selected from the group consisting of a titanate, a zirconate and an aluminate.

15. The propellant composition of claim 2 in which there is at least one of an additive selected from opacifiers; stabilizers; metal de-activators; anti-oxidants; flame colorants; or an agent that modifies the processing, performance, mechanical properties, storage stability or shelf life of solid propellant systems.

16. The propellant composition of claim 15 in which said stabilizer is selected from zinc oxide, nickel oxide and triacetin, and the flame colorant is selected from salts of strontium, barium, sodium and lithium.

17. The propellant composition of claim 2 in which said oxidizer is a mixture of particle sizes selected from coarse, medium, fine and ultra fine particles, said coarse particles being 400–600 micron, said medium particles being 50–200 micron, said fine particles being 5–15 micron and said ultra fine particles being submicron to 5 micron.

18. A gas generator propellant comprising the propellant composition of claim 2.

19. A rocket propellant comprising the propellant composition of claim 2.

20. The propellant composition of claim 2 in which at least 75% by weight of the material is oxidizer.

21. The propellant composition of claim 2 additionally comprising a plasticizer that is solid or semi-solid at 20° C., and an additive to increase one or more of elongation, adhesion and tack.

22. The propellant composition cf claim 21 in which the solid or semi-solid plasticizer is selected from microcrytallne wax, macrocrystalline wax, an oxidized hydrocarbon polyolefin andia polyketone wax and the additve is selected from a hydrogenated hydrocarbon resin and a derivative of a rosin.

23. The propellant composition of claim 2 in which the binder composition contains 35–65by weight of copolymner, 10–30% by weight of solid or semi-solid plasticizer and 20–40% by weight of said additive.

24. The propellant composition of claim 23 in which there is 10–20% of binder.

25. The propellant composition of claim 2 comprising 50–90% by weight of oxidizer and 5–20% by weight of ethylenetvinyl acetate copolymer, the remainder of such compositlon comprising at least one of said crystalline high explosive, plasticizer, energetic, ballistic modifier and other propellant components.

26. A method of manufactured of a propellant composition comprising:

(a) preparing a pre-propellant composition of ethylene copolymer; and (b) admixing the pre-popellant composition with a material selected from oxidizer and crystalline high explosive such that the resulting composition has at least 65% by weight of said material.

27. The method of claim 26 in which the propellant composition obtained in (b) is formed into propellant grains by an extrusion process.

28. The method of claim 27 in which the grain is consolidated into final form under mechanical, pneumatic or hydraulic pressure or centrifugal force.

29. The method of claim 28 in which the extrusion process utilizes a cooling cycle to cool the propellant grain.

30. The method of claim 28 in which the pre-propellant composition is prepared by molt blending.

31. The method of claim 28 in which the propellant composition obtained in (b) is formed into fuel grains in a ram extruder.

32. The method of claim 31 in which there is a cold cycle to cool the propellant grain so obtained.

33. The method of claim 26 in which the pre-propellant contains at least one of an energetic and ballistic modifier, said energetic being selected from the group consisting of aluminum, magnesium and aluminum/magnesium alloys, and said ballistic modifier is selected from the group consisting of oxides of iron, copper, chromiun and magnesium, and calcium carbonate.

34. The method of claim 33 in which the pre-propellant contains at least one additive selected from opacifiers; stabilizers; metal de-activators; anti-oxidants; flame colorants; or an agent that modifies the processing, performance, mechanical propefties, storage stability or shelf life of solid propellant systems.

35. The method of claim 28 in which the oxidizer of step (b) is selected from ammonium perchlorate, ammonium nitrate and potassium perchlorate.

36. The method of claim 26 in which the oxidizer is a mixture of particle sizes selected from coarse, medium, fine and ultra fine particles, said coarse particles being 400–600 micron, said medium particles being 50–200 micron, said fine particles being 5–15 micron and said ultra fine particles being submicon to 5 micron.

37. The method of claim 26 in which the ethylene co-polymer is ethylene/vinyl acetate polymer.

38. A solid propellant composition comprising a binder and at least 65% by weight of an oxidizer, said binder being an ethylene-vinyl alkanoate copolymer.

39. The propellant composition of claim 38 in which the copolymer is ethylene/vinyl acetate copolymer.

40. The propellant composition of claim 39 in which the copolymer of the binder has a moisture crosslinkable monomer.

41. The propellant composition of claim 40 in which the moisture crossilnkable monomer is selected from vinyl trimethoxysilane and vinyltriethoxysilane.

42. The propellant composition of claim 38 in which the binder is a silane-grafted ethylene/vinyl acetate copolymer.

UNITED STATES PATENT AND TRADEMARK OFFICE

CERTIFICATE OF CORRECTION

PATENT NO. : 6,740,180 B1
DATED : May 25, 2004
INVENTOR(S) : Anthony Joseph Cesaroni It is certified that error appears in the above-identified patent and that said Letters Patent is hereby corrected as shown below:

Column 14,
Line 65, “compositlor” should read -- composition --.
Line 66, “moboxide” should read -- monoxide --.

Column 15,
Line 5, “oi” should read -- in --.
Lines 7 and 9, “crosslinkable” should read -- cross linkable --.
Line 10, “vinyltriethoxysilane” should read -- vinyl triethoxyilane --.
Line 13, “composion” should read -- composition --.
Line 59, “microcrytallne” should read -- microcrystalline --.
Line 61, “andia” should read -- and a --.
Line 61, “additve” should read -- additive --.
Line 65, “35-65by” should read -- 35-65% --.
Line 66, “copolymner” should read -- copolymer --.

Column 16,
Line 2, “10-20%” should read -- 10-20% by weight --.
Line 5, “ethylenetvinyl” should read -- ethylene/vinyl --.
Line 6, “compositlon” should read -- composition --.
Line 9, “manufactured” should read -- manufacture --.
Line 13, “popellant” should read -- propellant --.
Line 24, “Claim 28” should read -- Claim 26 --.
Line 25, “molt” should read -- melt --.
Line 33, “sald” should read -- said --.

UNITED STATES PATENT AND TRADEMARK OFFICE

CERTIFICATE OF CORRECTION

PATENT NO. : 6,740,180 B1
DATED : May 25, 2004
INVENTOR(S) : Anthony Joseph Cesaroni It is certified that error appears in the above-identified patent and that said Letters Patent is hereby corrected as shown below:

Column 16,
Line 42, “propefties” should read -- properties --.
Line 44, “claim 28” should read -- claim 26 --.
Line 52, “submicon” should read -- submicron --.
Line 61, please strike “of the binder”.
Line 61, “crosslinkable” should read -- cross-linkable --.
Line 64, “crosslnkable” should read -- cross-linkable --.
Line 65, “vinyltriethoxysilane” should read -- vinyl triethoxysilane --.

Signed and Sealed this

Eighth Day of November, 2005

JON W. DUDAS
*Director of the United States Patent and Trademark Office*